US008783136B2

(12) United States Patent
Workman

(10) Patent No.: US 8,783,136 B2
(45) Date of Patent: Jul. 22, 2014

(54) BULB CHANGER ATTACHMENT SYSTEM

(76) Inventor: Ernest Workman, Cowley, WY (US)

( * ) Notice: Subject to any disclaimer, the term of this patent is extended or adjusted under 35 U.S.C. 154(b) by 177 days.

(21) Appl. No.: 13/281,217

(22) Filed: Oct. 25, 2011

(65) Prior Publication Data

US 2012/0103141 A1 May 3, 2012

Related U.S. Application Data

(60) Provisional application No. 61/409,443, filed on Nov. 2, 2010.

(51) Int. Cl.
*H01K 3/32* (2006.01)

(52) U.S. Cl.
USPC ..... 81/53.12

(58) Field of Classification Search
USPC ..... 81/53.1, 53.11, 53.12
See application file for complete search history.

(56) References Cited

U.S. PATENT DOCUMENTS

| | | | | |
|---|---|---|---|---|
| 2,637,587 | A | 5/1953 | Robinson et al. | |
| 5,148,723 | A | 9/1992 | Newman, Sr. et al. | |
| 5,218,889 | A | 6/1993 | Brockberg | |
| 7,234,743 | B2 | 6/2007 | Robinson | |
| 7,334,503 | B1 | 2/2008 | Newman | |
| 7,631,579 | B2 | 12/2009 | Johnson et al. | |
| 2004/0206210 | A1 * | 10/2004 | Tryba | 81/53.1 |
| 2012/0222521 | A1 * | 9/2012 | Becker | 81/53.11 |

* cited by examiner

*Primary Examiner* — Hadi Shakeri
(74) *Attorney, Agent, or Firm* — RG Patent Consulting, LLC; Rachel Gilboy

(57) ABSTRACT

A bulb changer attachment system comprising: a conical suction light bulb receiver having a distal end and a proximal end; a base having a top portion and a bottom portion; an adapter; and a vacuum hose attachment providing vacuum communication with at least one vacuum. The conical suction light bulb receiver is connected to the top portion of the base while the bottom portion of the base is connectable to the vacuum hose attachment via the adapter. A light bulb is received by the conical suction light bulb receiver such that an apex of the light bulb is suction-contacted by the proximal end of the conical suction light bulb receiver and an outer periphery is suction-contacted via the distal end of the conical suction light bulb receiver. The conical suction light bulb receiver is removeably-coupleable to the light bulb enabling a user to remotely access the light bulb for changing.

17 Claims, 5 Drawing Sheets

(Optional embodiment)

BULB CHANGER ATTACHMENT SYSTEM

CROSS-REFERENCE TO RELATED APPLICATION

The present application is related to and claims priority from prior provisional application Ser. No. 61/409,443, filed Nov. 2, 2010 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of vacuum tools and more specifically relates to vacuum tools used to change light bulbs.

2. Description of the Related Art

The incandescent light bulb, makes light by heating a metal filament wire to a high temperature until it glows. The hot filament is typically protected from air by a glass bulb that is evacuated and filled with inert gas. In a halogen lamp, a chemical process returns metal to the filament, extending its life. The light bulb is supplied with electrical current by feed-through terminals or wires embedded in the glass. Most bulbs are used in a socket which supports the bulb mechanically and connects the current supply to the bulb's electrical terminals.

Incandescent bulbs are produced in a wide range of sizes, light output, and voltage ratings, from 1.5 volts to about 300 volts. They require no external regulating equipment and have a low manufacturing cost and work equally well on either alternating current or direct current. As a result, the incandescent lamp is widely used in household and commercial lighting, for portable lighting such as table lamps, car headlamps, and flashlights, and for decorative and advertising lighting. These lights fail after repeated use and need to be changed.

Unfortunately, many consumers experience difficulty changing light bulbs in hard to reach areas such as in ceiling light fixtures. These bulbs can be very high up, and may therefore be virtually inaccessible to consumers without the use of stools or ladders. Further, standing on stools, ladders, and other objects may prove dangerous, and may put users at risk of falling and incurring injuries. This can be particularly risky and difficult for elderly or less agile individuals. Additionally, light bulbs may break when being grasped to be changed creating risk of injury for such individuals. A safe and efficient means for changing expired light bulbs is desirable.

Various attempts have been made to solve the above-mentioned problems such as those found in U.S. Pat. Nos. 7,234,743; 7,334,503; 5,218,889; 7,631,579; 5,148,723; and 2,637,587. This prior art is representative of light bulb changing tools. None of the above inventions and patents, taken either singly or in combination, is seen to describe the invention as claimed.

Ideally, a vacuum tool used to change light bulbs should be user-friendly, and yet would operate reliably and be manufactured at a modest expense. Thus, a need exists for a reliable bulb changer attachment system to quickly and easily change light bulbs located in ceiling light fixtures and to avoid the above-mentioned problems.

BRIEF SUMMARY OF THE INVENTION

In view of the foregoing disadvantages inherent in the known light bulb changing tools art, the present invention provides a novel bulb changer attachment system. The general purpose of the present invention, which will be described subsequently in greater detail is to provide a vacuum tool used to couple to and change light bulbs located in ceiling light fixtures quickly and easily.

The present invention, bulb changer attachment system, as disclosed herein, preferably comprises: a conical suction light bulb receiver having a distal end and a proximal end; a base having a top portion and a bottom portion; an adapter; and a vacuum hose attachment providing vacuum communication with at least one vacuum. The conical suction light bulb receiver is connected to the top portion of the base (or integral with in alternate embodiments.) Further, the conical suction light bulb receiver preferably comprises soft, (pliable) flexible rubber thereby being attachable to varying sizes of the outer periphery of the light bulb. The soft, flexible rubber provides a conforming seal with the light bulb when the vacuum communication is commenced.

The light bulb (being changed) is couplably-received by the conical suction light bulb receiver such that an apex of the light bulb is suction-contacted by the proximal end of the conical suction light bulb receiver and an outer periphery is suction-contacted via the distal end of the conical suction light bulb receiver. The distal end of the conical suction light bulb receiver comprises a diameter greater than the proximal end of the conical suction light bulb, making the shape conical. A distance between the distal end and the proximal end of the conical suction light bulb is variable since the conical suction light bulb receiver comprises the soft, flexible rubber, enabling varying sizes of the light bulb to be changed. Further, the conical suction light bulb receiver is removeably-coupleable to the light bulb enabling a user to remotely access the light bulb from a hard-to-reach surface and remove the light bulb via a negative pressure placed on the light bulb.

The base preferably comprises hard/rigid plastic, may be reversible and is cylindrically-shaped. Further, the base may comprise a rotatable impeller. If present, the rotatable impeller comprises at least one bladed fan. The rotatable impeller is driven by the negative pressure of the vacuum in a clockwise direction to create a turning torque on the light bulb thereby causing the light bulb to be tightened into a socket. The rotatable impeller when reversed is driven by the negative pressure of the vacuum in a counter-clockwise direction to create a turning torque on the light bulb thereby causing the light bulb to be loosened from a socket. The impeller may be housed in other portions of the present invention and may be operated (forward and reversed) via other means.

In certain embodiments an adapter is rotatable such that the impeller movement maybe operated in forward or reverse. In alternate embodiments the base is initially oriented in a first orientation and is reversible via removing the base and inserting the base at 180 degrees in a second orientation relative to the first orientation. The first orientation and the second orientation both comprise a lengthwise relationship between the conical suction light bulb receiver and the adapter. The bottom portion of the base is connectable to the vacuum hose attachment via the adapter. The vacuum hose attachment allows the conical suction light bulb receiver to be in vacuum communication with at least one vacuum through the base and the adapter, with the vacuum being remotely placed.

A kit is embodied herein for the bulb changer attachment system comprising: at least one base; at least one conical suction light bulb receiver; a vacuum hose attachment optionally having at least one impeller; and a set of user instructions.

In accordance with the embodiments of the present invention a preferred method of use is disclosed herein comprising: inserting a light bulb into a conical suction light bulb receiver; attaching a vacuum to a vacuum hose attachment; activating the vacuum to provide a vacuum communication and resulting suction (negative pressure) in a vacuum hose attachment for temporary securement of the light bulb; and turning the light bulb (installing or removing.)

The present invention holds significant improvements and serves as a bulb changer attachment system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, bulb changer attachment system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a vacuum tool used to change a light bulb and more particularly to a bulb changer attachment system that quickly and easily changes light bulbs located in ceiling light fixtures and to avoid the above-mentioned problems.

Figure 1:
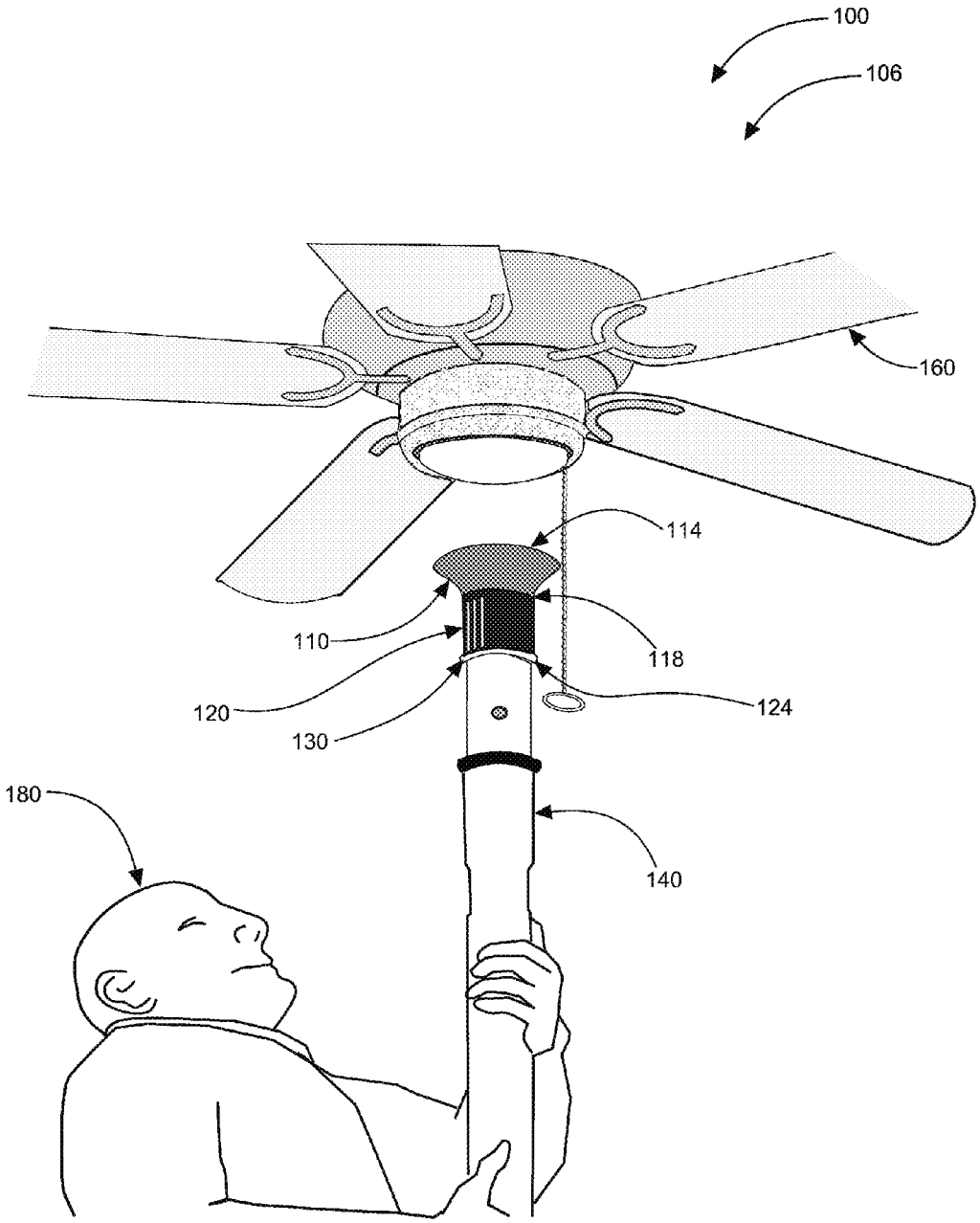
FIG. 1 shows a perspective view illustrating a bulb changer attachment system in an 'in-use' condition showing a light bulb being removed from a light fixture according to an embodiment of the present invention.
Figure 2:
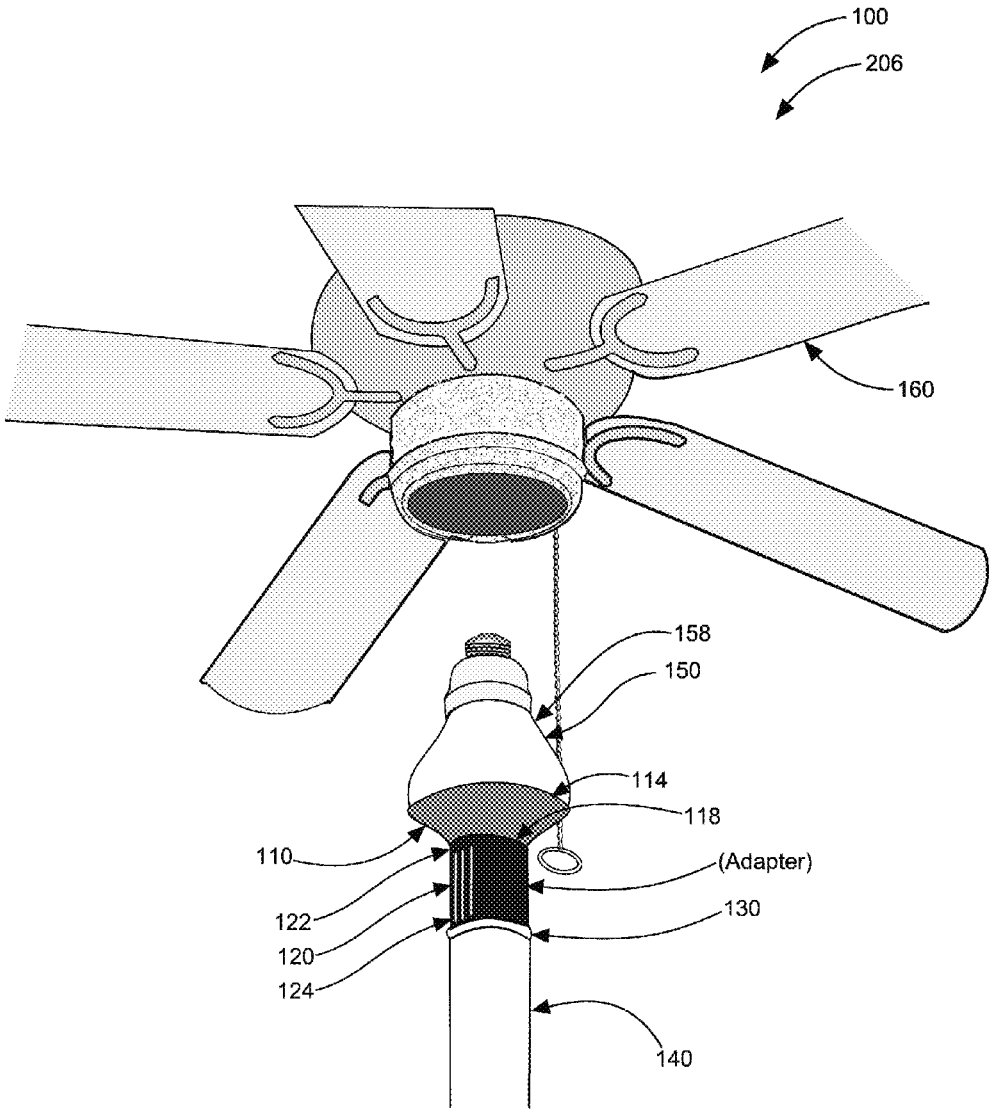
FIG. 2 shows a perspective view illustrating a conical suction light bulb receiver and a base of the bulb changer attachment system according to an embodiment of the present invention.
Figure 3:
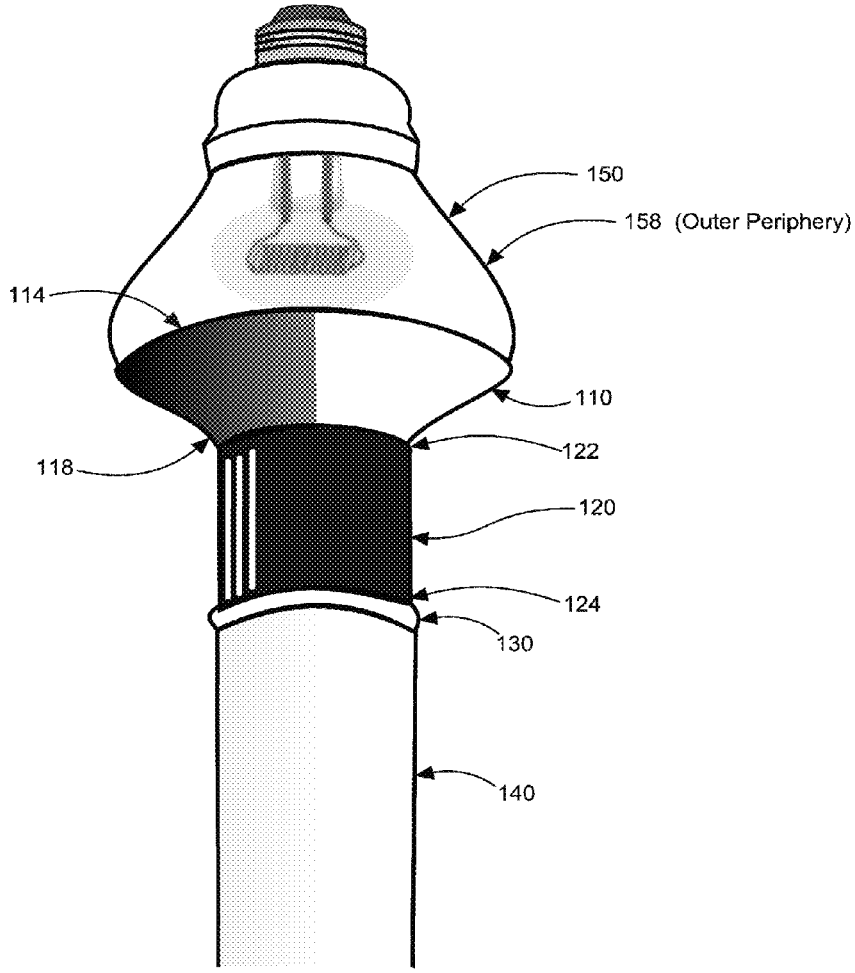
FIG. 3 shows a perspective view illustrating the bulb changer attachment system in the 'in-use' condition showing the light bulb being inserted into the light fixture according to an embodiment of the present invention.

Referring now to FIGS. 1-3 showing perspective views of bulb changer attachment system 100 in 'in-use' condition 106 and 'in-use' condition 206 according to embodiments of the present invention. Bulb changer attachment system 100 preferably comprises conical suction light bulb receiver 110, base 120, adapter 130, and vacuum hose attachment 140. Conical suction light bulb receiver 110 is removeably-coupleable to light bulb 150 enabling user 180 to remotely access light bulb 150 from a hard-to-reach location and remove light bulb 150 via a negative pressure placed on light bulb 150. The hard-to-reach location may include but is not limited to a ceiling, or near a top portion of a wall, such as in a dwelling that includes vaulted ceilings.

As shown in 'in-use' condition 106 of FIG. 1, bulb changer attachment system 100 may be used to remove light bulb 150 from a lighting fixture, as shown here in FIG. 1, the light fixture comprises ceiling fan 160. Bulb changer attachment system 100 may also be used to insert light bulb 150 into the lighting fixture, as shown here in FIG. 2, the light fixture also comprises ceiling fan 160 in FIG. 1 as well. Further, the design of the present invention substantially eliminates breaking of light bulb 150 during changing due to its pliable conformability and soft materials used therein. Should breakage occur, the broken glass is held remote from the individual and is substantially contained within conical suction light bulb receiver 110.

Figure 4A:
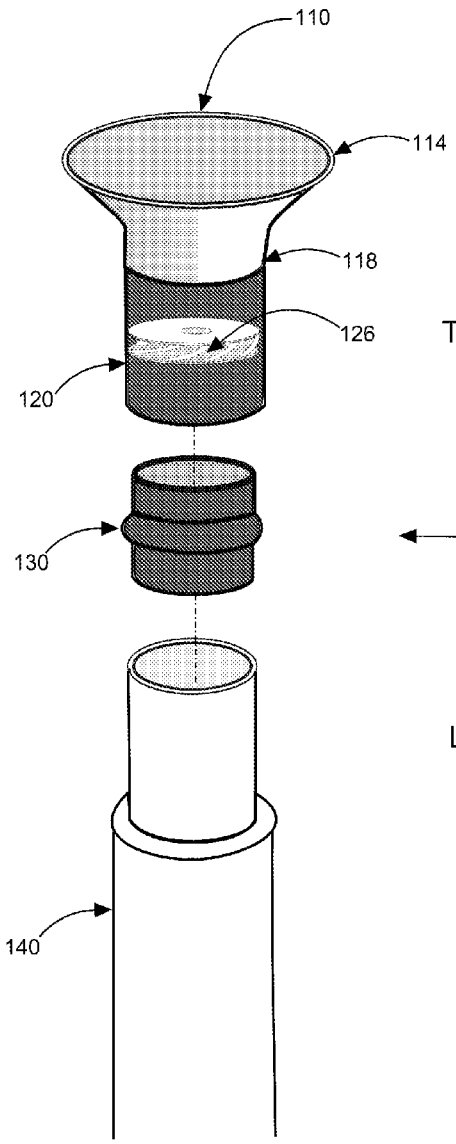
FIG. 4A shows another perspective view illustrating the base having a rotatable impeller of the bulb changer attachment system to an alternate embodiment of the present invention.
Figure 4B:
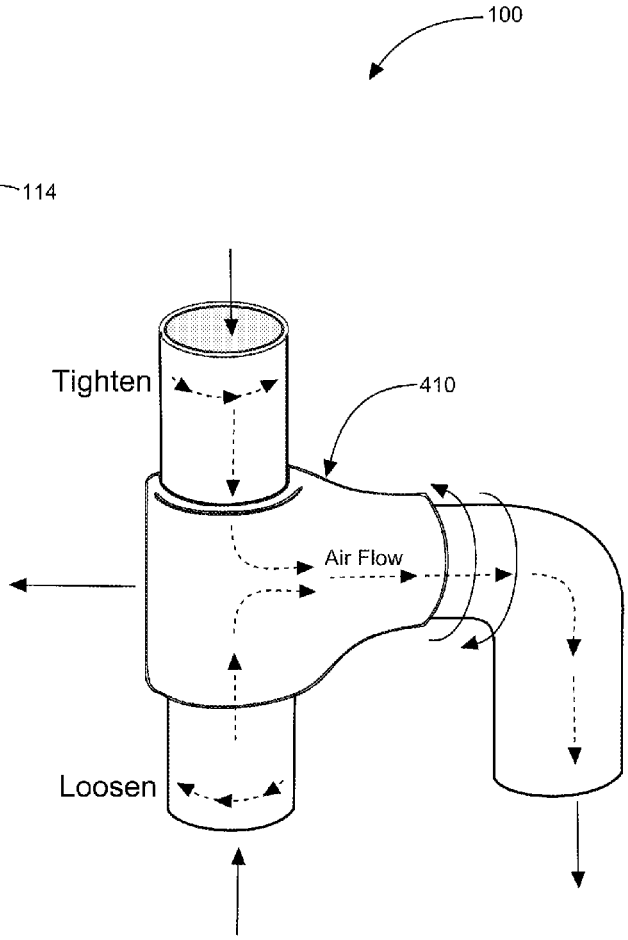
FIG. 4B shows a perspective view illustrating another alternate embodiment of the bulb changer attachment system as used to determine airflow direction for forward or reverse turning of the light bulb according to the present invention.

Referring now to FIGS. 3 & 4A and 4B showing perspective views of conical suction light bulb receiver 110 and base 120 of bulb changer attachment system 100 according to embodiments of the present invention.

Conical suction light bulb receiver 110 preferably includes distal end 114 and proximal end 118 attached and defined by the ends of the conical profile. Conical suction light bulb receiver 110 is preferably connected to top portion 122 of base 120 as shown best in FIG. 3. Light bulb 150 is preferably received by conical suction light bulb receiver 110 such that apex 154 of light bulb 150 is preferably suction-contacted by proximal end 118 of conical suction light bulb receiver 110 and outer periphery 158 of light bulb 150 is suction-contacted via distal end 114 of conical suction light bulb receiver 110 as shown best in FIG. 3. Vacuum hose attachment 140 may allow conical suction light bulb receiver 110 to be in vacuum communication with at least one vacuum through base 120 and adapter 130 with the vacuum preferably being remotely placed. It should be noted that a wide array of vacuums may be removeably-coupleable to vacuum hose attachment 140.

Conical suction light bulb receiver 110 preferably comprises soft, flexible rubber (readily deformable and pliable to various bulbous shapes) thereby being attachable to varying sizes of outer peripheries 158 of light bulb 150. Distal end 114 of conical suction light bulb receiver 110 comprises a diameter greater than proximal end 118 of conical suction light bulb receiver 110 as shown best in FIG. 3. The distance between distal end 114 and proximal end 118 of light bulb 150 may be variable since conical suction light bulb receiver 110 comprises soft, flexible rubber, thereby enabling varying sizes of light bulb 150 to be changed. In this way the present invention serves to provide service over a wide range of light bulb 150 sizes and contours. The soft, flexible rubber, provides a seal with light bulb 150 when vacuum communication is commenced. Upon reading this specification, it should be appreciated that, under appropriate circumstances, considering such issues as user preferences, design preference, structural requirements, marketing preferences, cost, available materials, technological advances, etc., other material arrangements such as, for example, soft plastics, etc., may be sufficient.

Base 120 preferably comprises top portion 122 and bottom portion 124 as shown best in FIGS. 3 and 4A. Base 120 preferably comprises a cylindrical profile. Further, base 120 may comprise hard plastic. Upon reading this specification, it should be appreciated that, under appropriate circumstances, considering such issues as user preferences, design preference, structural requirements, marketing preferences, cost, available materials, technological advances, etc., other strong, rigid and durable materials such as, for example, rubber or ferrous or non-ferrous materials, composites, etc., may be sufficient.

Base 120 may further comprise rotatable impeller 126 having at least one bladed fan as shown best in FIG. 4A and not shown in FIG. 4B (although it is assumed to be present.) Rotatable impeller 126 is preferably driven by negative pressure of the vacuum in a clockwise direction to create a turning torque on light bulb 150 thereby causing light bulb 150 to be tightened into a socket. Additionally, rotatable impeller 126 when reversed is driven by the negative pressure of the vacuum in a counter-clockwise direction to create a turning torque on light bulb 150 thereby causing light bulb 150 to be loosened from the socket. FIG. 4A and FIG. 4B illustrate different means for creating forward or reverse directional air flow (movement) used to tighten or loosen light bulb 150. It should be appreciated that other means for reversing direction of impeller 126 may be employed and still will be considered to be within the scope of the present invention. Rotatable impeller 126 may also be housed in different locations such as in adapter 130.

As per FIG. 4A, base 120 may be initially oriented in a first orientation and is reversible via removing base 120 and inserting base 120 at 180 degrees in a second orientation relative to the first orientation. The first orientation and the second orientation both comprise a lengthwise relationship between conical suction light bulb receiver 110 and adapter 130 in this particular embodiment.

Referring now to FIG. 4B showing another perspective view illustrating another alternate embodiment of bulb changer attachment system 100. Alternatively as shown, bulb changer attachment system 100 may include (swivel-rotatable) spinner attachment 410 that may swivel to determine air flow direction relative to impeller 126. Spinner attachment 410 permits user(s) 180 to connect vacuum hose attachment 140 in various positions thereby re-directing air flow from the vacuum. In certain embodiments a vacuum may not be used.

Bulb changer attachment system 100 according to an embodiment of the present invention of FIGS. 1-5 may comprise kit 540. Kit 540 may comprise the following parts: at least one base 120; at least one conical suction light bulb receiver 110; vacuum hose attachment 140 having at least one rotatable impeller 126; and a set of user instructions. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately.

Figure 5:
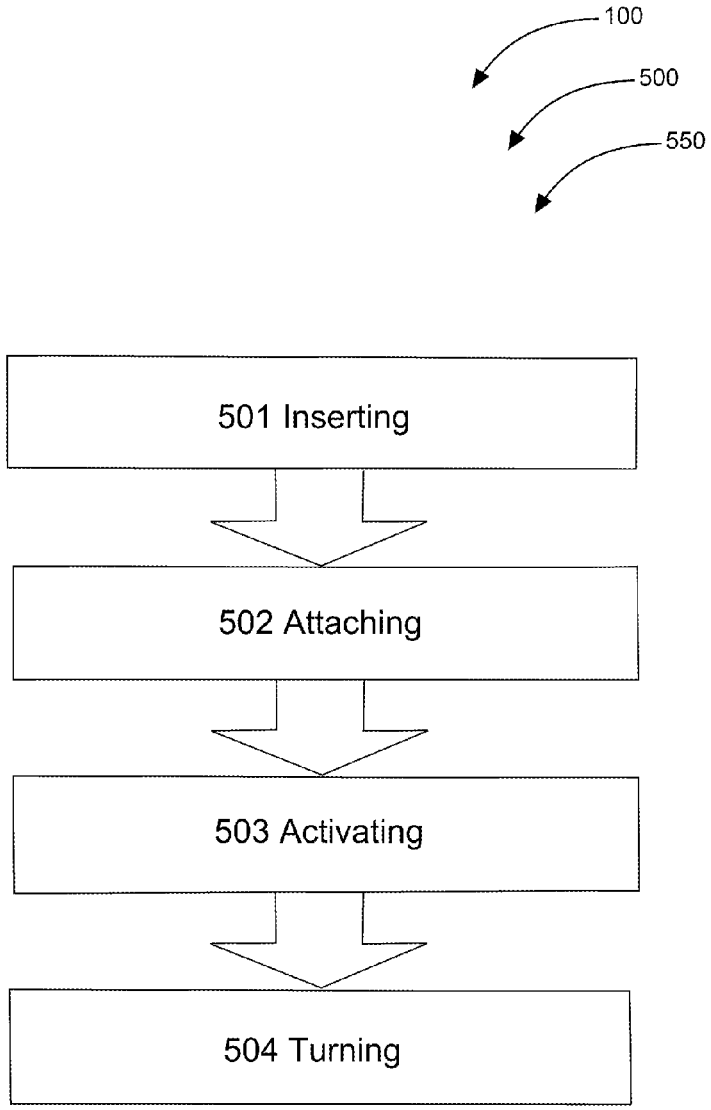
FIG. 5 is a flowchart illustrating a method of use of the bulb changer attachment system according to an embodiment of the present invention of FIGS. 1-4B.

FIG. 5. shows flowchart 550 illustrating method of use 500 according to an embodiment of the present invention of FIGS. 1-4B. A method of using (at least herein enabling method of use 500) bulb changer attachment system 100 may comprise the steps of: step one 501 inserting light bulb 150 into conical suction light bulb receiver 110; step two 502 attaching a vacuum to vacuum hose attachment 140; step three 503 activating the vacuum to provide a vacuum communication (to provide suction) in vacuum hose attachment 140 for temporary securement of light bulb 150; and step four 504 turning light bulb 150. The turning of light bulb 150 comprises removing of light bulb 150 via reversing a base having a rotatable impeller 126. Further, the step of turning light bulb 150 may comprise installing of light bulb 150.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A bulb changer attachment system comprising:

a conical suction light bulb receiver having a distal end and a proximal end;

a base having a top portion and a bottom portion, said base comprising a rotatable impeller;

an adapter; and a vacuum hose attachment providing vacuum communication with at least one vacuum;

wherein said conical suction light bulb receiver is connected to said top portion of said base;

wherein a light bulb is received by said conical suction light bulb receiver such that an apex of said light bulb is suction-contacted by said proximal end of said conical suction light bulb receiver and an outer periphery is suction-contacted via said distal end of said conical suction light bulb receiver;

wherein said bottom portion of said base is connectable to said vacuum hose attachment via said adapter;

wherein said vacuum hose attachment allows said conical suction light bulb receiver to be in vacuum communication with at least one vacuum through said base and said adapter, said vacuum being remotely placed; and wherein said conical suction light bulb receiver is removeably-coupleable to said light bulb enabling a user to remotely access said light bulb from a hard- to-reach location and remove said light bulb via a negative pressure placed on said light bulb;

wherein said rotatable impeller is driven by said negative pressure of said vacuum in a clockwise direction to create a turning torque on said light bulb thereby causing said light bulb to be tightened into a socket.

2. The bulb changer attachment system of claim 1 wherein said base is reversible or said adapter is swivelable.

3. The bulb changer attachment system of claim 2 wherein said rotatable impeller when reversed is driven by said negative pressure of said vacuum in a counter-clockwise direction to create a turning torque on said light bulb thereby causing said light bulb to be loosened from a socket.

4. The bulb changer attachment system of claim 2 wherein said base is initially oriented in a first orientation and is reversible via removing said base and inserting said base at 180 degrees in a second orientation relative to said first orientation.

5. The bulb changer attachment system of claim 4 wherein said first orientation and said second orientation both comprise a lengthwise relationship between said conical suction light bulb receiver and said adapter.

6. The bulb changer attachment system of claim 1 wherein said rotatable impeller comprises at least one bladed fan.

7. The bulb changer attachment system of claim 1 wherein said base comprises rigid plastic.

8. The bulb changer attachment system of claim 1 wherein said base comprises a cylindrical profile.

9. The bulb changer attachment system of claim 1 wherein said conical suction light bulb receiver comprises soft, flexible rubber thereby being contour-attachable to varying sizes of said outer periphery of said light bulb.

10. The bulb changer attachment system of claim 9 wherein said distal end of said conical suction light bulb receiver comprises a diameter greater than said proximal end of said conical suction light bulb.

11. The bulb changer attachment system of claim 10 wherein a distance between said distal end and said proximal end of said conical suction light bulb receiver is variable since said conical suction light bulb receiver comprises said soft, flexible and pliable rubber, enabling varying sizes of said light bulb to be changed.

12. The bulb changer attachment system of claim 11 wherein said soft, flexible and pliable rubber, provides a seal with said light bulb when said vacuum communication is commenced.

13. A bulb changer attachment system comprising:

a conical suction light bulb receiver having a distal end and a proximal end;

a reversible cylindrical-shaped base having a top portion and a bottom portion;

an adapter; and a vacuum hose attachment providing vacuum communication with at least one vacuum;

wherein said conical suction light bulb receiver is connected to said top portion of said base;

wherein a light bulb is received by said conical suction light bulb receiver such that an apex of said light bulb is suction-contacted by said proximal end of said conical suction light bulb receiver and an outer periphery is suction-contacted via said distal end of said conical suction light bulb receiver;

wherein said conical suction light bulb receiver comprises soft, flexible rubber thereby being attachable to varying sizes of said outer periphery of said light bulb;

wherein said soft, flexible rubber, provides a seal with said light bulb when said vacuum communication is commenced;

wherein said distal end of said conical suction light bulb receiver comprises a diameter greater than said proximal end of said conical suction light bulb;

wherein a distance between said distal end and said proximal end of said conical suction light bulb receiver is variable since said conical suction light bulb receiver comprises said soft, flexible rubber, enabling varying sizes of said light bulb to be changed;

wherein said base comprises hard plastic;

wherein said base or said adapter comprises a rotatable impeller;

wherein said rotatable impeller comprises at least one bladed fan;

wherein said rotatable impeller is driven by said negative pressure of said vacuum in a clockwise direction to create a turning torque on said light bulb thereby causing said light bulb to be tightened into a socket;

wherein said rotatable impeller when reversed is driven by said negative pressure of said vacuum in a counter-clockwise direction to create a turning torque on said light bulb thereby causing said light bulb to be loosened from a socket;

wherein said base is initially oriented in a first orientation and is reversible via removing said base and inserting said base at 180 degrees in a second orientation relative to said first orientation;

wherein said first orientation and said second orientation both comprise a lengthwise relationship between said conical suction light bulb receiver and said adapter;

wherein said bottom portion of said base is connectable to said vacuum hose attachment via said adapter;

wherein said vacuum hose attachment allows said conical suction light bulb receiver to be in vacuum communication with at least one vacuum through said base and said adapter, said vacuum being remotely placed; and wherein said conical suction light bulb receiver is removeably-coupleable to said light bulb enabling a user to remotely access said light bulb from a hard-to-reach location and remove said light bulb via a negative pressure placed on said light bulb.

14. The bulb changer attachment system of claim 13 further comprising a kit including: said at least one base; at least one said conical suction light bulb receiver; said vacuum hose attachment having said at least one said impeller; and a set of user instructions.

15. A method of using a bulb changer attachment system comprising the steps of:

Providing a light bulb attachment system according to claim 1;

inserting a light bulb into the conical suction light bulb receiver;

attaching a vacuum to the vacuum hose attachment;

activating said vacuum to provide a vacuum communication to provide suction in the vacuum hose attachment for temporary securement of said light bulb; and turning said light bulb.

16. The method of using a bulb changer attachment system of claim 15 wherein said step of turning said light bulb comprises removing of said light bulb via reversing the base having said impeller.

17. The method of using a bulb changer attachment system of claim 15 wherein said step of turning said light bulb comprises installing of said light bulb.

* * * * *